US005873555A

United States Patent [19]

Crace

[11] Patent Number: 5,873,555

[45] Date of Patent: Feb. 23, 1999

[54] RIMMED CONTAINER MOUNTING ASSEMBLY

[75] Inventor: J. Timothy Crace, Belews Creek, N.C.

[73] Assignee: RBI, An Alaskan Limited Patnership, Stanley, N. Mex.

[21] Appl. No.: 816,802

[22] Filed: Mar. 19, 1997

[51] Int. Cl.[6] ..... A47K 1/08

[52] U.S. Cl. ..... 248/312.1; 248/215

[58] Field of Search ..... 248/312.1, 313, 248/316.1, 316.4, 316.6, 215, 216.1, 217.3, 230.3, 231.41, 292.12

[56] References Cited

U.S. PATENT DOCUMENTS

| | | | |
|---|---|---|---|
| 2,823,004 | 2/1958 | Melloh | 248/215 |
| 2,879,023 | 3/1959 | Barrier et al. | 248/226 |
| 2,967,691 | 1/1961 | Lehnbeuter et al. | 248/311.2 |
| 3,001,753 | 9/1961 | Smith | 248/313 |
| 3,310,911 | 3/1967 | Boser et al. | 47/39 |
| 3,807,674 | 4/1974 | Justen | 248/315.2 |
| 4,880,133 | 11/1989 | Cullinane | 220/85 |
| 5,074,504 | 12/1991 | Minnick | 248/372.1 |
| 5,118,059 | 6/1992 | Mainer | 248/215 |
| 5,316,251 | 5/1994 | McGraw | 248/210 |
| 5,381,993 | 1/1995 | Eckler | 248/312.1 |
| 5,395,080 | 3/1995 | Smith | 248/215 |
| 5,405,116 | 4/1995 | Shepherd et al. | 248/312.1 |
| 5,413,297 | 5/1995 | Adams | 248/215 |
| 5,487,517 | 1/1996 | Smith | 248/215 |
| 5,535,971 | 7/1996 | Adams | 248/215 |

*Primary Examiner*—Leslie A. Braun
*Assistant Examiner*—Anita M. King
*Attorney, Agent, or Firm*—Cahn & Samuels, LLP

[57] ABSTRACT

A rimmed container mounting assembly useful in the interior and horticultural design arts that provides a convertible hanger assembly incorporating a main body section with a rim receiving channel, a rim engaging lip, and a plurality of cooperating structures to permit for multiple attachment modes including direct attachment and overhanging attachment to uniform, non-uniform, or irregular mounting surfaces.

21 Claims, 5 Drawing Sheets

RIMMED CONTAINER MOUNTING ASSEMBLY

TECHNICAL FIELD

The present invention is directed to improvements in mounting assemblies for rimmed containers such as plant holders, flowerpots, and the like. More particularly, the invention provides an easily assemblable, installable, and, preferably, convertible fixture for supporting pot-like plant containers. The inventive mounting assembly herein defines a structural combination useful in the interior and horticultural design arts, particularly as applied to limited display spaces and in the case of non-uniform or irregular mounting surfaces.

BACKGROUND OF THE INVENTION

Hanger elements for mounting rimmed containers such as plant pots are useful for displaying plants on walls, over ledges, on railings, etc. One significant advance in the plant hanger and display field is represented by U.S. Pat. No. 5,074,504 issued on Dec. 24, 1991 to Bruce T. Minnick, the content of which is incorporated herein by reference. That invention discloses a pot holding fixture formed from molded plastic that is capable of retaining a rimmed pot in the upright position. The fixture includes front and back walls which are connected by a reinforcing web and defines an upright body where the back wall is flat and adapted to lie against a confronting flat surface. The front wall incorporates an inverted hook/shoulder combination adapted to receive and support a flowerpot. The fixture is attachable to a wall in a load bearing relation through a screw secured in a reinforced screw hole extending from the front wall and through to the back wall.

The flower pot is attached to the fixture by securing the rim thereof between a load carrying shoulder and the inverted hook. The lower wall section provides an angled wall complementary to the taper of the flowerpot rim. Upon engagement of the rim between the shoulder and inverted hook, the flower pot rim rests against the tapered section lower wall section and resists moving out of level.

Notwithstanding the usefulness of the above-described plant hanger invention, a need still exists for a versatile rimmed container system particularly suited for hanging potted plants where the system both is easily adjusted and is capable of convertible installation in a wide variety of structural environments typically encountered, e.g., walls, ledges, railings. Furthermore, a need remains for a general utility hanging assembly that not only is readily adapted to a variety of mounting environments, but also which provides uniformity in appearance and strength for residential and commercial use.

SUMMARY OF THE INVENTION

It is therefore an object of the present invention to provide a rimmed container support assembly that overcomes the above noted shortcomings and other problems of the prior art.

It is another object of the invention to provide an improved potted plant support assembly for heavy or light duty use in indoor and outdoor plant display.

It is another object of the invention to provide an improved, convertible hanger assembly capable of providing standardized appearance and adequate strength for general use in the indoor and outdoor decorative plant display fields.

Still another object of the present invention to provide a plant holder assembly capable of multiple attachment modes and adjusting to correspond to the dimensions of a contiguous attachment surface mounting.

A further object of this invention is to provide a plant holder assembly structure providing, at once, simplicity, standardized sizes, conformation uniformity, adequate strength, structural integrity, and convertiblity.

Still another object of the invention is to provide a plant holder assembly permitting maximum visual observation of a plant mounted thereto.

A further object of this invention is to provide an attractive general utility plant holder assembly that may be conveniently, efficiently, and inexpensively manufactured, assembled, and mounted with minimal labor and time.

It is another object of this invention to provide for customizable plant hanger allowing selection of decorative surfaces and color.

These and other objects are satisfied by a convertible hanger assembly, comprising:

a main body for securing a rimmed container, said main body being elongated, defining a front, a back, side walls, and a top;

said front including an upper wall portion and a lower wall portion;

said back defining an opened back surrounded by a rim lying in a plane which is adapted for confronting engagement against a contiguous surface and being established by the back edges of said side walls and said top wall;

a descending lip portion formed integrally with said upper wall portion;

a weight supporting shoulder projecting rearwardly toward said back a select distance from the front of said lower wall portion to define a channel between it and said descending lip portion, said channel being adapted to receive a portion of a rim of the rimmed container;

a feedthrough aperture formed in and extending through said upper portion and through said main body, said feedthrough aperture being disposed generally orthogonally relative to the axis of elongation of said main body, located above the descending lip and the channel, and being dimensioned to receive a cooperating securing element; and a support receiving means formed in said main body including a first element of a cooperating interlocking member, said support receiving means being located between the top and said feedthrough aperture, and said support receiving means adapted to cooperate with a first elongate interconnecting member which includes a second element of the cooperating interlocking member where said interconnecting member is securable to said support receiving means by engagement of said first and second elements to establish the cooperating interlocking member.

Further objects of the present invention are satisfied by a multi-mode hanger assembly, comprising:

a main body for securing a rimmed container to a structure, said main body being elongated and having a securing affixation combination, said affixation combination defining at least a first and a second, affixation means;

said first affixation means defining a first feedthrough aperture including a first element of a first cooperating interlocking member, and a first elongate member dimensionally sized to be received within said first aperture and including a second cooperating element of the first cooperating interlocking member to cooperate with said first element to positionally interlock said first elongate member with respect to said main body;

said second affixation means defining a second feedthrough aperture and said second feedthrough aperture including a first element of a second cooperating interlocking member, a second elongate member dimensionally sized to be received within said second aperture and including a second cooperating element of the second cooperating interlocking member to cooperate with said first element to positionally interlock said second elongate member with respect to said main body; and said first and second apertures lie in a first plane and a second plane respectively, said first and second planes being disposed at an angle in respect to one another and generally orthogonally relative to the axis of elongation of said body.

Still other objects of this invention are satisfied by a method of securing a rimmed container to convertible hanger assembly according to the invention comprising the step of engaging the plant pot rim between the descending lip and the shoulder of the main body.

This invention also provides a method of adjustably mounting a plant pot support assembly on a selected structural surface.

As used herein, "affixation" is intended to embrace its ordinary meaning and in the context of the instant invention, allows for functional stabilization of the novel assembly and/or the combination of the assembly with a rimmed container.

As used herein, "stabilizer" and "stabilize" are intended to embrace their ordinary meaning and in the context of the instant invention, allows for functional positional stabilization of the novel assembly and/or the combination of the assembly with a rimmed container.

Given the following enabling description of the drawings, the inventive assembly should become evident to a person of ordinary skill in the art.

DETAILED DESCRIPTION OF THE PREFERRED EMBODIMENT

Figure 1:
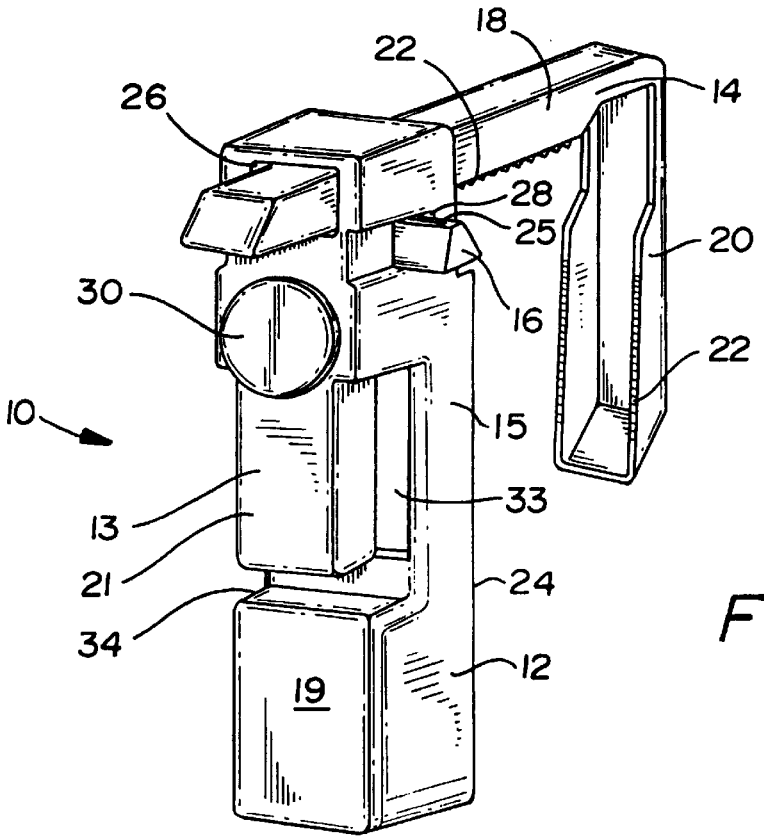
FIG. 1 is a perspective view of a first embodiment of a hanger unit according to the invention.

FIG. 1 illustrates an embodiment of the hanger/bracket member 10 of the novel rimmed container assembly of the present invention which is particularly suited for display of plants. The member 10 comprises a multi-mode component body established by a combination of a vertically disposed main body 12, an L-shaped attachment hook member 14, and a lateral, key stabilizer bar 16. The L-shaped hook member 14 is formed by a generally horizontal arm 18 and a vertical leg 20 including friction grip serrations 22 formed along a portion of the inner edge thereof.

The main vertically disposed body 12 defines a generally hollow, C-shaped structure having a front face 13, side walls, and a back edge 24 adapted to abut against a confronting surface such as a wall or rail. The main body 12 is generally defined by an upper segment 17 and a lower segment 19. The upper segment 17 includes feedthrough apertures 26 and 28 which are disposed perpendicularly to one another. As illustrated, the uppermost aperture 26 is disposed in the front face of the upper segment 17. The lower feed through aperture 28 is also positioned in the upper segment 17 but is disposed laterally, passing through the side walls 15.

Advantageously, the aperture 28 is located both near the back edge 24 of the main body 12 and below the level of the upper aperture 26. A depending rim engaging lip 21, projects downwardly from the upper segment, is narrower than the upper segment 17, and comprises one of the confronting surfaces establishing the engaging element for the container rim.

Figure 2:
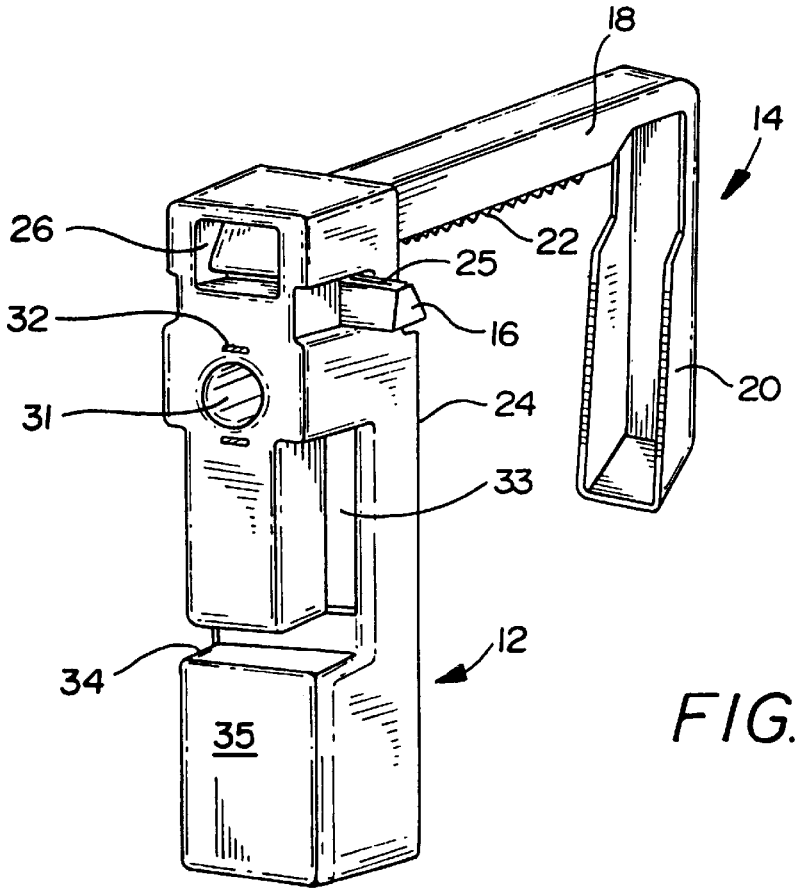
FIG. 2 is perspective partial assembly view of the embodiment illustrated in FIG. 1.
Figure 3:
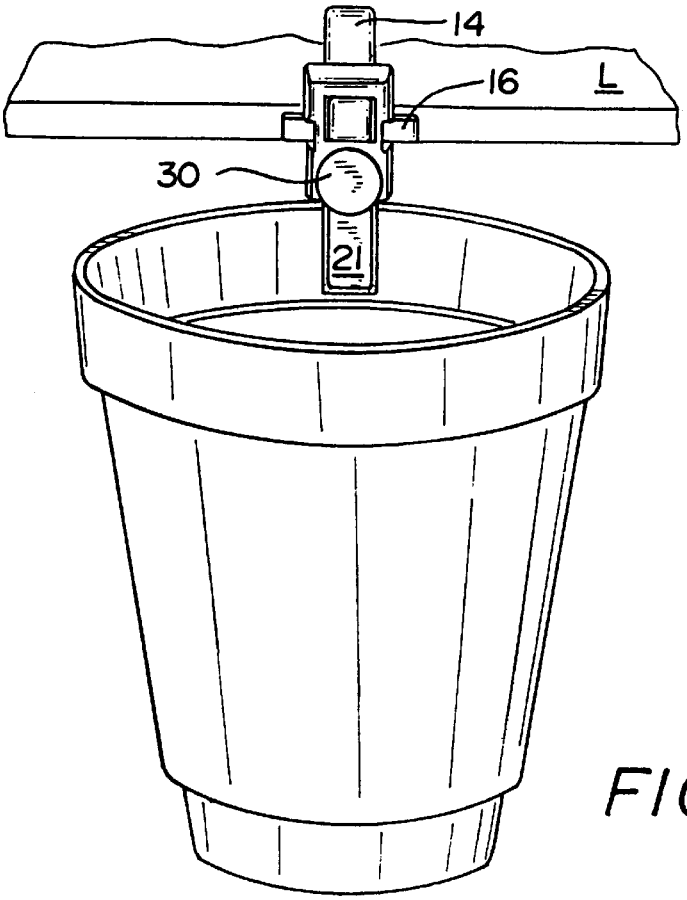
FIG. 3 is front view of the embodiment illustrated in FIG. 1 in assembly with a rimmed plant pot and mounted over a wall ledge.
Figure 4:
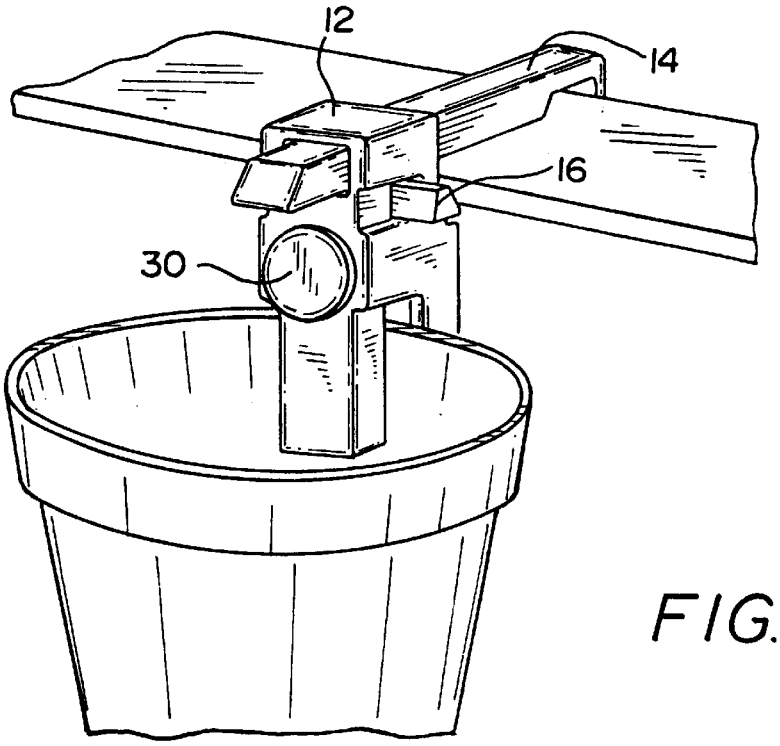
FIG. 4 is perspective view of the assembly embodiment illustrated in FIG. 3.

FIG. 1 depicts a cap-type cover 30 centrally located along the front face, above the depending lip 21 and below the apertures 26 and 28. The cap 30 conceals an underlying feedthrough boss 31 (See FIG. 2) which extends through to the back of the main body 12 and which preferably is both threaded and reinforced. In one attachment mode of the assembly, the feedthrough boss 31 is intended to receive and retain a screw for securing the main body 12 to an underlying structure. As illustrated, the aperture 31 is flanked by a pair of tine receiving openings 32 that receive tines (not-illustrated) projecting from the back of the cap 30 to affix the cap to the main body 12.

Figure 6:
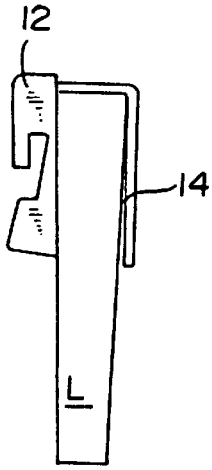
FIG. 6 is a side view of the second embodiment of the hanger unit depicted in FIG. 5 in and assembled combination with a plant pot and mounted over a wall divider.
Figure 7:
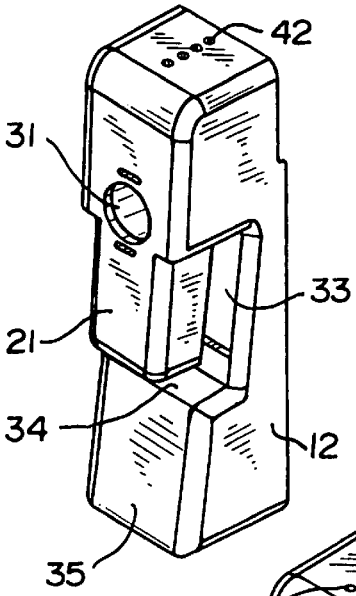
FIG. 7 is a front view of a third embodiment of a hanger unit in accordance with the invention.
Figure 8:
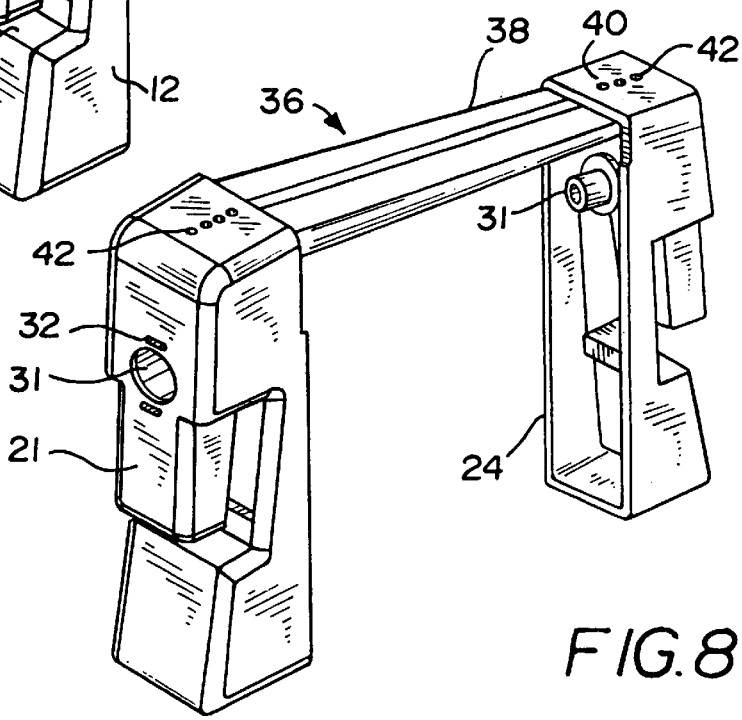
FIG. 8 is a perspective view of the third embodiment depicted in FIG. 7 in a tandem mounting combination for mounting over a ledge or rail.
Figure 9:
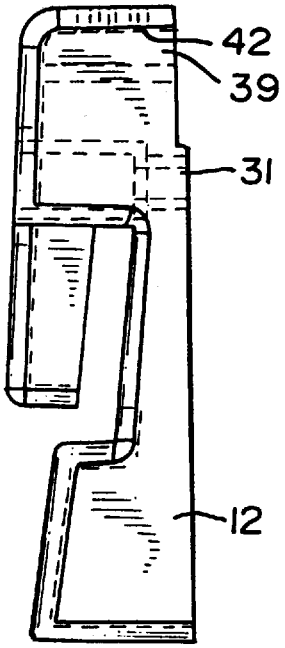
FIG. 9 is a cross-sectional view of the third embodiment depicted in FIG. 7.

The lower segment 19 of the main body 12 includes a rim receiving, angled, L-shaped channel 33 disposed behind and below the depending lip 21. The bottom of the rim receiving channel 33 is defined by a weight bearing horizontal shoulder 34 upon which a container rim rests. The channel 33 advantageously is angled to receive and embrace the frustoconical rim of a conventional plant pot or a plant pot designed specifically for the invention. The front face 35 of the lower segment 19 features an angle correspondingly to the taper of the rim to maximize the juxtaposed surface area between the main body 12 and the plant pot. This relationship is illustrated in FIG. 6.

In the foregoing description, reference has been made to a "direct" attachment mode of the main body 12 to a wall via a screw secured through boss 31. The second described affixation mode contemplated by the invention is the "overhang" method.

The overhang method features a hook member 14 adapted to interlock with the main body 12 in aperture 26 to form an integral, inverted U-shaped hanger assembly that is removable. Because interlocking of the hook member 14 does not interfere with the boss 31, both can be employed for complementary affixation. Thus, a user can be provided with an increased degree of affixation confidence by relying on both the above-described "direct" attachment mode and the "overhang" mode.

The "overhang" method is achieved using, in assembly, a hook member 14 inter-engaged with the main body 12. The hook member 14 generally defines an L-shaped element with a shorter leg 20 and a longer leg 18. Both legs have identical cross-sectional dimensions so as to be interchangeable with respect to insertion into the aperture 26.

The interior edges of the legs 18 and 20 feature serrations 22 which perform two distinct functions. The first function concerns augmenting the frictional engagement of the depending leg with the confronting wall or rail surface. The second function is to cooperate with corresponding, confronting, serrated teeth 25 formed on the upper surface of stabilizer key 16 or formed along the interior of aperture 26 to establish an interlock. The height of the aperture 26 advantageously is equal to the thickness of the legs plus the depth of one tooth. Consequently, the legs can translate within the aperture 26 and interlock by inter-engagement of confronting serrated teeth formed either within the aperture or on a the confronting top surface of the lateral stabilizer bar 16 when acting as a key. Because the inter-engagement of the teeth positionally lock the position of the arm relative to the main body, incremental translation of the arm prior to engagement permits adjustment of the leg length to correspond to the width of the wall/rail.

The lateral stabilizer key bar 16 provides for enhanced lateral stabilization of the mounted assembly. The lateral stabilizer bar 16 has a trapezoidal cross-section with a 5° taper in the direction of elongation. Thus, it is dimensioned to provide both a friction/interference fit and to interlockingly translate within a lateral aperture/keyway 28 formed at the upper back end of the main body 12. Preferably, the stabilizer bar 16 features cooperating serrated teeth like those provided on hook member 14, to augment the interference fit within the aperture 28 and thus enhance positioning security of the stabilizer bar 16 within the aperture/keyway 28. When so arranged, the lateral stability of the assembly is enhanced so as to minimize undesirable tilting and the inter-engagement of the lateral arm 16 and hook member 14 is maximized.

Figure 5:
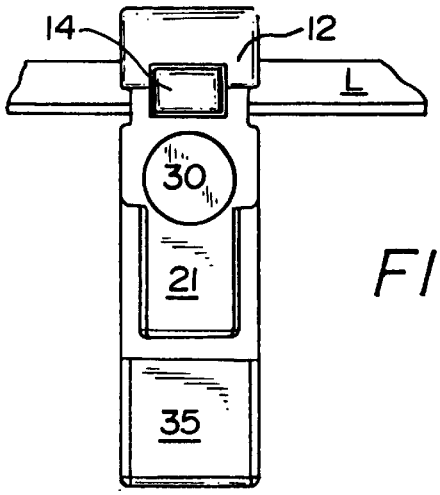
FIG. 5 is a front view of a second embodiment of a hanger unit according to the invention.

The invention also is readily adaptable to a number of additional structural modifications and variations. As depicted in FIG. 5, one such variation includes provision for only the direct and overhang attachment modes. Thus, the FIG. 5 and 6 embodiment provides a simpler structure than that depicted in FIGS. 1–4 by providing only the direct attachment boss underlying the cover 30 and the hook member 14 in the complementary aperture 26. This simplified embodiment does not include the lateral stabilizer. However, as depicted in FIG. 6, the simplified embodiment provides an effective hanger-plant pot assembly mounting over ledge L.

FIGS. 7 through 10 illustrate a further variation of the invention. These figures feature a tandem hanger assembly 36 established by two oppositely facing main bodies 40 joined by a common beam connector 38. Each of the main bodies includes a boss 31 for direct attachment and provides a beam supporting shelf 39 with a plurality of aligned detenting holes 42. As detailed in FIG. 10, the beam connector 38 features protrusions 43 which are dimensioned to be received in and register with one of the detenting holes 42. This arrangement permits relatively fine adjustment of the relative length of the tandem assembly 36.

Unlike the previously described embodiments, however, the support shelf 39 does not feedthrough to the front wall 17 of the main body 40. Therefore, this variation of the invention contemplates gross width adjustment to be achieved by providing a plurality of beams 38 having different lengths or a telescoping beam structure.

Figure 11:
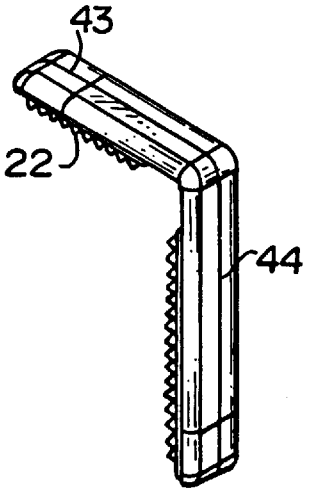
FIG. 11 is a perspective view of the over-ledge support member of FIGS. 5 and 6.

FIG. 11, depicts an L-shaped hook 44 incorporating both serrations 22 and registering protrusions 43. This embodiment of a hook member provides multiple attachment modes adaptable for use with either of the disclosed main body structures 12 or 40.

Figure 12:
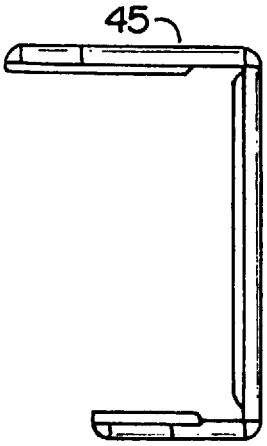
FIG. 12 is a variation of the support member of FIG. 11.

In FIG. 12, a further structural variation of the hook 44 is illustrated. In this case, the hook element 45 is C-shaped so as to be advantageously employed for mounting on a railing with an open bottom.

Figure 13:
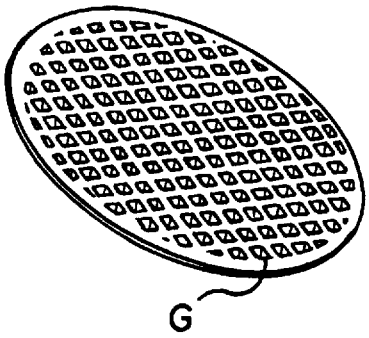
FIG. 13 is a perspective view of a grate member for locating in a plant pot.
Figure 10:
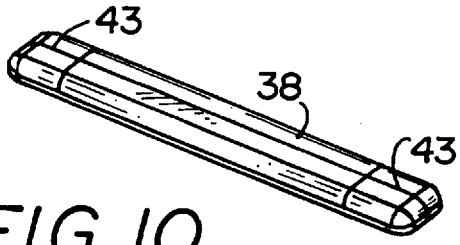
FIG. 10 is a perspective view of the tandem support member of FIG. 8.
Figure 14:
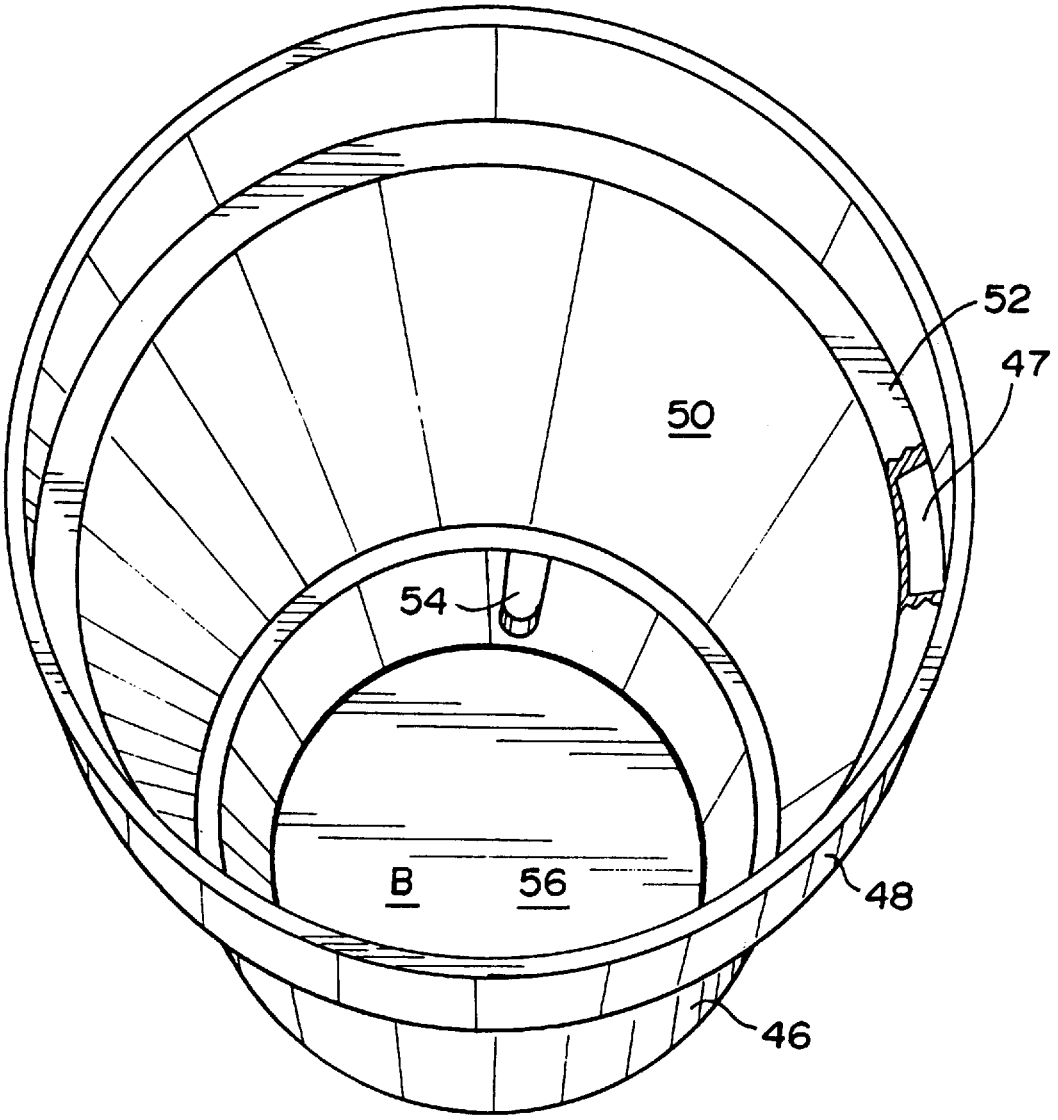
FIG. 14 is a perspective view of a rimmed plant pot according to the invention.

FIGS. 13 and 14 illustrate some detail relating to a rimmed pot suitable for use with the above-described hanger assemblies. FIG. 13 illustrates a drainage grate G for placement near the bottom the outer container 46, the purpose of which is described below. The outer container 46 includes a tapering frusto-conical surface 48 including frusto-conical rim 47 defining an assembly supporting annulus adapted to be received in the channel 33 and to rest on the shoulder 34. Preferably, the outer container 46 contains an inner ring (not illustrated) formed above its base to support the drainage grate G thereby leaving an opening of selected volume. The outer container 46 is dimensioned to receive and nest inner plant pot container 50. Preferably, the inner container includes a rim 52 that seats on the interior surface of the outer container annulus 47, a plurality of perforations 54 formed along its base to permit water drainage, and a height between the rim 52 and its base 56 less than the distance between the inner ring supported drainage grate and the annulus 47 so that the base 56 lies on or above the drainage grate G.

It should be apparent to the skilled artisan, that any appropriate composition may be used to establish the various above-described structures so long as such composition provides sufficient rigidity and strength to retain structural integrity when combined with a plant holding pot, the environment most particularly suited for the invention. Preferably the assembly is formed from molded or cast polymeric resin. However, any sufficiently strong and rigid material such as glasses, ceramics and, metals with necessary properties can be substituted for such moldable plastics.

The design variations are essentially unlimited so long as the plant hanger assembly provides an adjustable, convertible structure with adequate strength and rigidity to maintain the integrity during use.

Given the foregoing, variations and modifications to the invention should now be apparent to a person having ordinary skill in the art. These variations and modifications are intended to fall within the scope and spirit of the invention as defined by the following claims.

We claim:

1. A convertible hanger assembly, comprising:

a main body for securing a rimmed container, said main body being elongated, defining a front, a back, side walls with back edges, and a top;

said front including an upper wall portion and a lower wall portion;

said back defining an opened back surrounded by a rim lying in a plane which is adapted for confronting engagement against a contiguous surface and being established by the back edges of said side walls and said top wall;

a descending lip portion formed integrally with said upper wall portion;

a weight supporting shoulder projecting rearwardly toward said back a select distance from the front of said lower wall portion to define a channel between it and said descending lip portion, said channel being adapted to receive a portion of a rim of the rimmed container;

a feedthrough aperture formed in and extending through said upper portion and through said main body, said feedthrough aperture being disposed generally orthogonally relative to the axis of elongation of said main body, located above the descending lip and the channel, and being dimensioned to receive a cooperating securing element; and a support receiving means formed in said main body including a first element of a cooperating interlocking member, said support receiving means being located between the top and said feedthrough aperture, and said support receiving means adapted to cooperate with a first elongate interconnecting member which includes a second element of the cooperating interlocking member where said interconnecting member is securable to said support receiving means by engagement of said first and second elements to establish the cooperating interlocking member.

2. The convertible hanger assembly according to claim 1 where said first elongate interconnecting member is a straight single beam type member with a first end and a second end and a confronting support surface, where each of said ends includes the second element of the cooperating interlock member whereby each of said ends of said support receiving means is capable of interconnecting with a main body.

3. The convertible hanger assembly according to claim 2 where said first elongate interconnecting member defines a flat lower surface adapted to lie on a flat structural member over which each main body hangs.

4. The convertible hanger assembly according to claim 1 where said first elongate interconnecting member is an L-shaped member adapted to be secured over a ledge type structure in a manner to support the container.

5. The convertible hanger assembly according to claim 1 where said first elongate interconnecting member is adapted to be secured around a rail type structure in a manner to support the container.

6. The convertible hanger assembly according to claim 1 further including a bottom main body wall defining a back edge lying in said plane.

7. The convertible hanger assembly according to claim 6 where said main body is substantially hollow.

8. The convertible hanger assembly according to claim 7 where said feedthrough aperture defines a cylindrical reinforcement boss extending from the front face of the main body to said plane and a cooperating securing element which is a threaded screw and further comprising a cap engagable with said main body and dimensioned to conceal said feedthrough aperture.

9. The convertible hanger assembly according to claim 1 where said support means is dimensionally sized to be received within said feedthrough aperture and including a second cooperating element of the first cooperating interlocking member to cooperate with said first element to positionally interlock said first elongate member with respect to said main body.

10. The convertible hanger assembly according to claim 1 further comprising a stabilizer receiving means defining a stabilizer aperture which includes a first element of a second cooperating interlocking member, a elongate stabilizer member having a length greater than the width of said main body, said elongate stabilizing member being dimensionally sized to be received within said second aperture and including a second cooperating element of the second cooperating interlocking member to cooperate with said first element of the second cooperating interlocking member to positionally interlock said elongate stabilizer member with respect to said main body.

11. The convertible hanger assembly according to claim 10 where said stabilizer aperture is a feedthrough aperture, said support receiving means and said stabilizer feedthrough aperture lie in a first, second, and third planes respectively, where said first and second planes are generally orthogonally relative to the axis of elongation of said body and said stabilizer positionally stabilizes the main body.

12. The convertible hanger assembly according to claim 11 where said first and third planes are co-planer.

13. The convertible hanger assembly according to claim 11 where said first and second elements of the first and second cooperating interlocking members comprise cooperating serrated teeth.

14. A multi-mode hanger assembly, comprising:

a main body for securing a rimmed container to a structure, said main body being elongated and having a securing affixation combination, said affixation combination defining at least a first and a second, affixation means;

said first affixation means defining a first feedthrough aperture including a first element of a first cooperating interlocking member, and a first elongate member dimensionally sized to be received within said first aperture and including a second cooperating element of the first cooperating interlocking member to cooperate with said first element to positionally interlock said first elongate member with respect to said main body;

said second affixation means defining a second feedthrough aperture and said second feedthrough aperture including a first element of a second cooperating interlocking member, a second elongate member dimensionally sized to be received within said second aperture and including a second cooperating element of the second cooperating interlocking member to cooperate with said first element to positionally interlock said second elongate member with respect to said main body; and said first and second apertures lie in a first plane and a second plane respectively, said first and second planes being disposed at an angle in respect to one another and generally orthogonally relative to the axis of elongation of said body.

15. The multi-mode hanger assembly according to claim 14 where said first affixation means includes a straight single beam type member with a first end and a second end and a confronting support surface, where each end includes the second element of the first cooperating interlocking member whereby said single beam interconnects two main bodies, one at each of said first and second ends.

16. The multi-mode hanger assembly according to claim 14 where the first affixation means includes an L-shaped attachment member.

17. The multi-mode hanger assembly according to claim 14 where the first affixation means includes a C-shaped attachment member.

18. The multi-mode hanger assembly according to claim 14 further comprising a third affixation means defining a third feedthrough aperture dimensioned to receive a cooperating third securing element, said third feedthrough aperture being disposed generally orthogonally relative to the axis of elongation of said body and where said third feedthrough aperture defines a cylindrical reinforcement boss extending through the main body to said plane and said third securing element is a threaded screw and further comprising a cap engagable with said main body and dimensioned to conceal said feedthrough aperture.

19. The multi-mode hanger assembly according to claim 14 further comprising a rim receiving channel formed by said main body and a cooperating rim engaging lip formed integrally with said main body.

20. The multi-mode hanger assembly according to claim 19 further comprising rimmed flower pot.

21. The multi-mode hanger assembly according to claim 20 where said rimmed flower pot is established by a combination of an inner pot for containing a plant and a rimmed outer liner pot for retaining said inner pot and for attaching to said hanger assembly.

* * * * *